US005529734A

United States Patent [19]

Shah

[11] Patent Number: 5,529,734

[45] Date of Patent: Jun. 25, 1996

[54] PROCESS FOR MAKING AND COLLECTING CONTINUOUS FIBERS IN THE FORM OF A ROD-SHAPED BATT

[75] Inventor: Ashok H. Shah, Chesterfield, Va.

[73] Assignee: E. I. Du Pont de Nemours and Company, Wilmington, Del.

[21] Appl. No.: 287,606

[22] Filed: Aug. 9, 1994

[51] Int. Cl.[6] ..... D01D 5/11; D01D 7/00

[52] U.S. Cl. ..... 264/103; 264/205; 264/211; 264/211.14

[58] Field of Search ..... 264/13, 103, 205, 264/211, 211.14

[56] References Cited

U.S. PATENT DOCUMENTS

| | | | |
|---|---|---|---|
| 3,081,519 | 3/1963 | Blades et al. | 57/248 |
| 3,227,794 | 1/1966 | Anderson et al. | 264/205 |
| 3,413,185 | 11/1968 | Davis et al. | 428/394 |
| 3,417,431 | 12/1968 | Majoch | 425/381 |
| 3,600,483 | 8/1971 | Davis et al. | 264/53 |
| 4,352,650 | 10/1982 | Marshall | 425/174.8 |

FOREIGN PATENT DOCUMENTS

| | | | |
|---|---|---|---|
| 597658 | 5/1994 | European Pat. Off. | 264/205 |

*Primary Examiner*—Leo B. Tentoni

[57] ABSTRACT

This invention relates to making backwindable rod shaped batts or logs from highly oriented flash-spun continuous fibers. The fibers are conducted from the exit of a spinneret through a tunnel and into a two stage diverging nozzle to slow down the fibers for an organized collection in the collection section. The invention further includes an inflatable bladder in a discharge section for initiating the formation of the log and a mesh screen in the collection section for reducing the occurrence of fiber blow out through the gas discharge ports.

1 Claim, 2 Drawing Sheets

PROCESS FOR MAKING AND COLLECTING CONTINUOUS FIBERS IN THE FORM OF A ROD-SHAPED BATT

FIELD OF THE INVENTION

The present invention generally relates to collecting highly oriented flash-spun continuous backwindable fibers from a spinneret in the form of a rod-shaped batt, commonly referred to as a log.

BACKGROUND AND SUMMARY OF THE INVENTION

In the past, it has been desirable to collect flash-spun continuous fibers from a spinneret in the form of a rod-shaped batt, commonly known as a log, wherein the fiber in the batt may be unwound from the end opposite from which the fiber was fed into the batt. This is commonly referred to as being backwindable. For example, U.S. Pat. Nos. 3,413,185; 3,417,431; and 3,600,483 all disclose processes for forming such logs. In brief, the process for forming such logs generally comprises collecting the fiber from a spinneret in a tubular shaped perforated collecting conduit. As the fiber collects therein, it takes the shape of the conduit, i.e. a rod shaped batt. The solvent, which is discharged from the spinneret with the polymer fiber, flash evaporates and expands into the conduit compressing the fiber into the log, pushing the log forward in the conduit, and escaping through the gas release ports in the periphery of the conduit.

In the foregoing references, it should be noted that the spinneret does not include a tunnel at the exit thereof. As is disclosed in U.S. Pat. Nos. 3,081,519 (Blades et al.) and 3,227,794 (Anderson et al.), a tunnel has a significant effect on fiber tenacity. U.S. Pat. No. 4,352,650 (Marshall) discusses the optimization of tunnel configuration for increasing fiber tenacity from about 4.2 gpd to about 5.2 gpd, wherein fiber tenacity is described as being increased by as much as 1.3 to 1.7 times by using an appropriately sized tunnel at the exit of the spinneret. Accordingly, it would be very desirable to use a tunnel and obtain higher tenacity fiber for the rod-shaped batts.

However, when collecting the fiber into a log, it has long been believed that the expanding jet of solvent vapor must be allowed to expand fully and quickly so as to reduce or avoid the turbulence that is created by the high speed gases downstream of the spinneret. Such turbulence tends to randomly collapse the fibers prior to the fibers being collected into the log, and the fibers become disorganized as they are collected. The fibers are thereby sufficiently entangled to render the resulting log difficult to backwind. It is much preferable for the fiber to be collected while still in the expanded state so as to form a more organized log which is far easier to backwind.

A further shortcoming of prior art logmaking methods is that quite frequently, fibers momentarily exit the gas release ports located along the fiber collection tube with the expanding gas. This condition damages the continuity of the plexifilamentary structure of the flash-spun fibers resulting in more frequent filament breaks during backwinding of the flash-spun fibers making up the log. Moreover, fibers exiting the gas release ports leave continuous marks in the form of heavy axial ribs on the surface of the resulting log. These axial ribs change the resistance of log motion through the collection tube in an unpredictable manner. Due to this condition, logs produced are not consistent in quality.

A further problem of prior art logmaking arrangements is the mechanical gate at the collection tube exit for initiating the logmaking process. The gate quite frequently catches fibers during start-up which results in start-up failures and adds to the cost of production.

Another problem with prior arrangements is the mechanical friction element such as rubber gaskets that provide resistance to the log passing out of the collection tube. Clearly, it is preferable for the logs to be discharged from the collection tube in a smooth, continuous and progressive manner. However, such mechanical devices are crude, unreliable and not adapted for adjusting or modifying the rate of discharge during operation of the collection arrangement.

Clearly, what is needed is an apparatus and method that overcome the problems and deficiencies inherent in the prior art. In particular, what is needed is a logmaking apparatus which will produce strong, highly oriented, flash-spun, continuous, backwindable fibers when formed into logs. Other objects and advantages of the present invention will become apparent to those skilled in the art upon reference to the attached drawings and to the detailed description of the invention which hereinafter follows.

The objects of the invention are achieved by the provision of an apparatus for collecting continuous fibers moving with a stream of relatively high speed gases into a nozzle section arranged to receive the fibers and high speed gases to gradually slow the gases and fibers prior to collection thereof in a collection tube. The nozzle section has a diverging internal contour wherein it has a diverging half angle of less than or equal to about 20 degrees and the collection tube is arranged to discharge the gases through the periphery and collect the fibers in a rod-shaped batt in the central passage thereof.

BRIEF DESCRIPTION OF THE DRAWINGS

An understanding of the above and other objects of the invention will now be more fully developed by a detailed description of the preferred embodiment. The attached drawings, in conjunction with the following description, may provide a more clear understanding of the invention. In the drawings.

DESCRIPTION OF THE PRIOR ART APPARATUS

Figure 1:
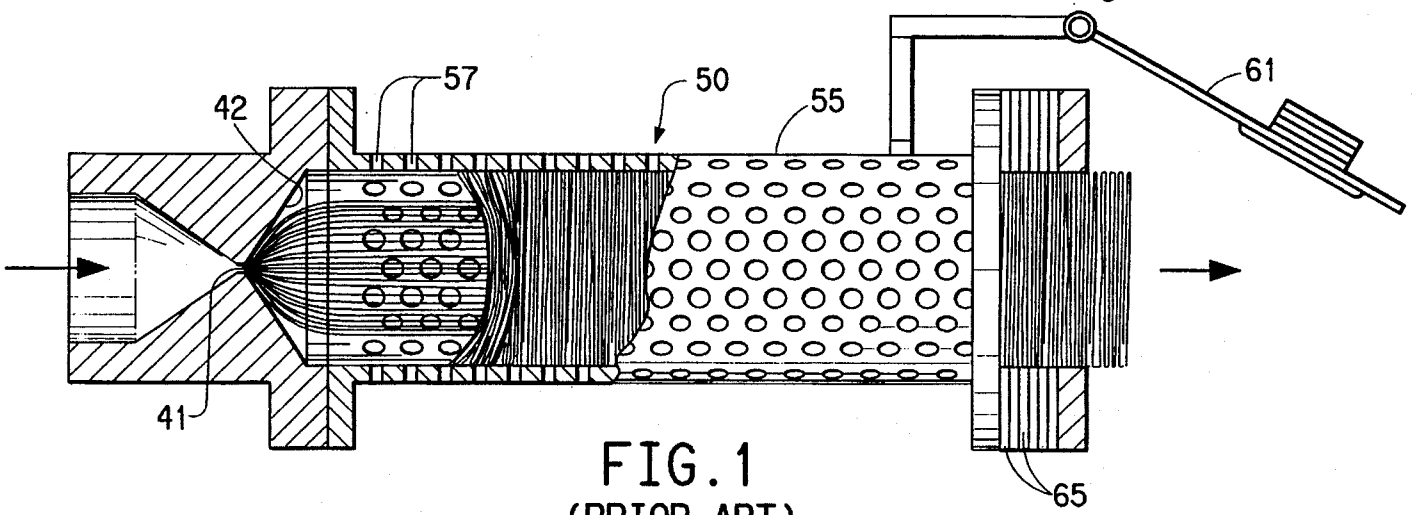
FIG. 1 (PRIOR ART)
FIG. 1 is a longitudinal cross sectional view of a logmaking apparatus which would be typical of the prior art.

Referring to FIG. 1 of the drawings, the apparatus generally indicated by the number 50 is representative of prior art apparatuses. The apparatus 50 generally comprises a tubular collection chamber 55 including a plurality of gas release ports 57. Fiber is delivered from a spinneret 41 through a broadly diverging conically shaped transition portion 42 into the collection chamber 55. Fiber collection is initiated by a mechanical gate 61 which swings down to block the exit of the collection chamber 55. Once the fiber batt has formed, the gate 61 is opened to allow the batt to move out the exit of the collection tube 55. In practice, the formation of the batt is faster than the rate at which the mechanical gate 61 can be opened for satisfactory initiation of the batt.

Movement of the battout of the tube 55 is slowed by a series of rubber gaskets 65 sized slightly smaller than the interior of the collection tube 55. However, depending on the size and smoothness of the log, the log may move at various rates from the collection tube 55.

DETAILED DESCRIPTION OF THE PREFERRED EMBODIMENTS

Figure 2:
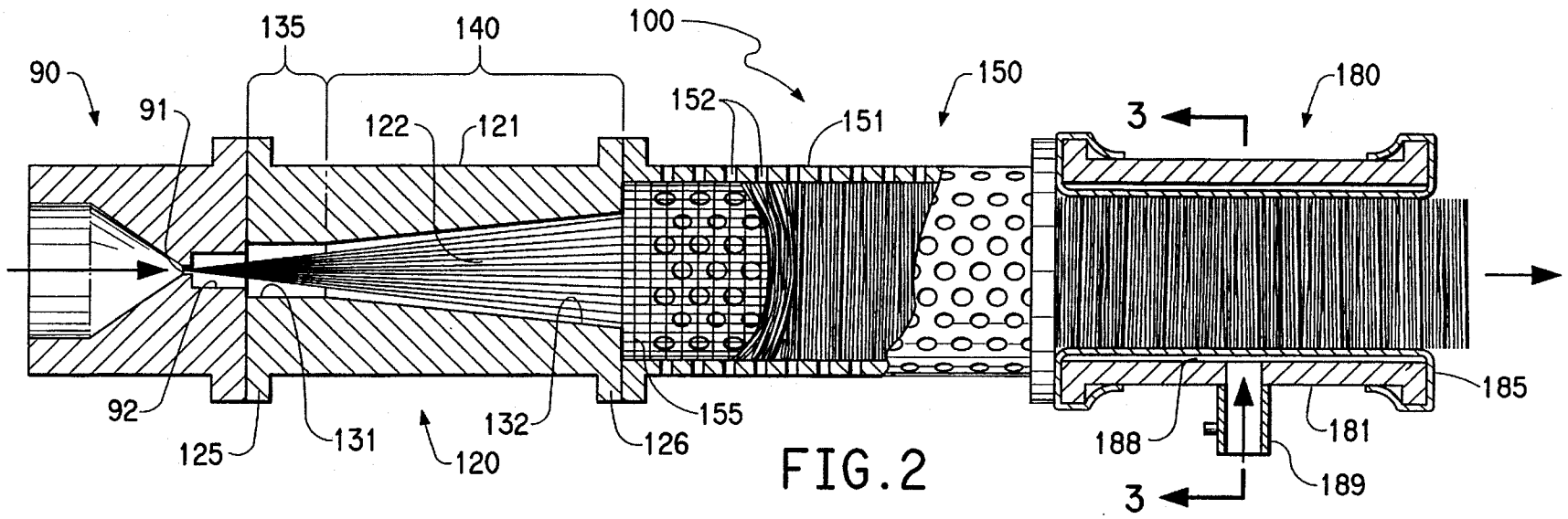
FIG. 2 is a longitudinal cross sectional view similar to FIG. 1 except of the preferred embodiment of the improved logmaking apparatus according to the present invention.
Figure 3:
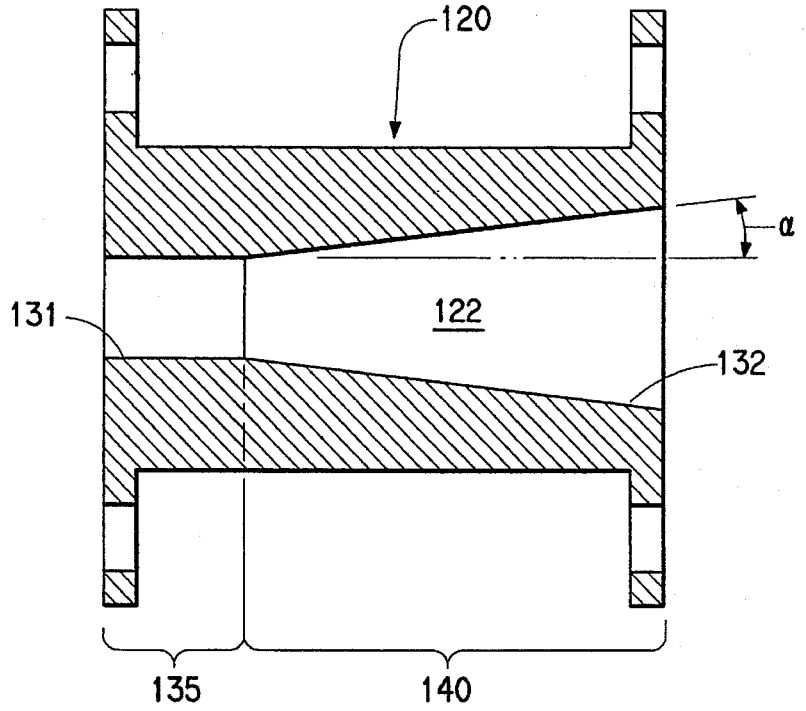
FIG. 3 is an enlarged longitudinal cross sectional view of the nozzle section of the apparatus of the present invention.
Figure 4:
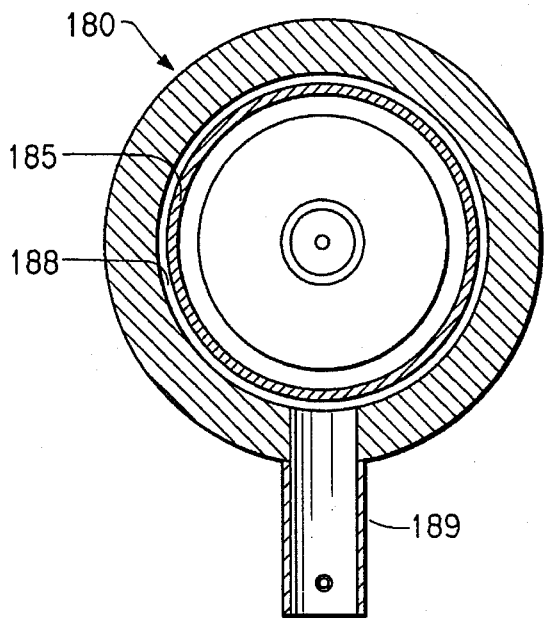
FIG. 4 is a transverse cross sectional view of the improved log making apparatus taken along line 3—3 in FIG. 2.
Figure 5:
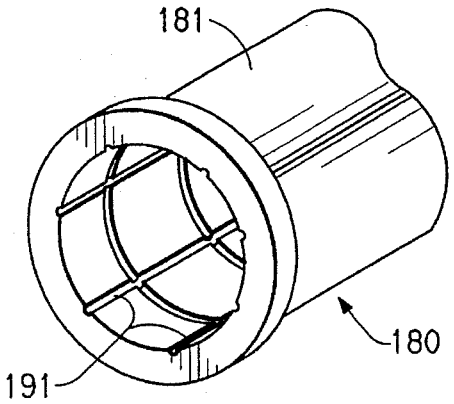
FIG. 5 is a fragmentary perspective view of the end of the discharge section with parts removed to reveal particular features of the invention.

Referring now more particularly to FIGS. 2, 3 and 4 of the drawings, a preferred embodiment of the apparatus for making flash-spun continuous backwindable fiber is generally indicated by the number 100. The apparatus 100 is attached to the exit tunnel 92 at the spinneret 91 of a conventional flash-spinning device 90. The apparatus 100 generally comprises three portions: (1) a nozzle section, generally indicated by the number 120; (2) a collection section, generally indicated by the number 150; and (3) a discharge section, generally indicated by the number 180. The three sections 120, 150 and 180 are connected preferably coaxially end to end such that the fiber is spun at the spinneret 91, passes through the tunnel 92 and into the apparatus 100, through the nozzle section 120, through the collection section 150, and finally through the discharge section 180.

The nozzle section 120 comprises a generally open ended tube 121 having open interior 122 and oriented generally coaxial with the tunnel 92. The nozzle portion 120 is provided with suitable flanges 125 and 126 at the ends thereof for attachment to the flash-spinning device 90 and the collection section 150, respectively. The open interior 120 has a generally circular cross section along its length through the nozzle portion 120 and the interior 122 is larger at the exit end 132 than it is at the inlet end 131. The nozzle section preferably has a length of at least 1.5 times its diameter at the inlet end thereof and an internal contour that preferably diverges from the inlet to the outlet. As will be described below, the diverging contour is not necessarily continuous or always diverging, but preferably does not include any portions with reducing diameter.

The open interior 122 includes a particular geometry which has two stages 135 and 140. The first stage 135 is generally cylindrical and extends for about 0.5 to 10 times the diameter thereof. The diameter of the first stage 135 is preferably larger than the diameter of the tunnel 92 such that the fiber leaving the tunnel 92 "sees" a step change in the diameter of the passageway from the spinneret 91 into the nozzle portion 120. It should be noted that such a step change is preferably a 90° step as illustrated in the drawing. However, it may be acceptable to arrange a step change such that the angle to the axis or centerline of the device may be considerably less than 90 degrees. In other words, the step may comprise a short portion that has a shape extending perhaps 45° relative to axis of the apparatus 100.

The step change is preferably considered by comparing the cross sectional areas of the straight cylindrical first stage 135 to the tunnel exit. It has been found that the cross sectional area of the first stage 135 should be at least 1.05X, but not more than 3X, of the tunnel exit cross sectional area. It is preferred that the step increase in cross sectional area is 1.1X to 1.8X the tunnel exit cross sectional area.

It is hypothesized that the step increase between the tunnel 92 and the first stage 135 of the nozzle section 120 provides at least two advantages. First, it does not hinder the expansion of the jet exiting the tunnel. Occasionally, an under expanded jet condition occurs due to minor solution flow rate fluctuations over time. Any hindrance to this under expanded jet at the exit of the tunnel 92 may effect plexifilamentary structure of the spun fibers in a negative way, such as heavy and poorly fibrillated lines and short tie points in the plexifilamentary structure.

Secondly, it is believed that the pressure fluctuations down stream of the tunnel become dampened out by the step change prior to such fluctuations being transmitted back to the tunnel 92. Pressure pulses in the tunnel 92 tend to render irregular fiber quality. These two advantages result in making "logs" having consistent fiber quality without the undesired defects, such as, the above described heavy and poorly fibrillated lines in the plexifilamentary structure of the spun fibers.

Moving along the nozzle section 120, the straight cylindrical first stage 135 of the two stage nozzle section 120 conducts the jet of solvent vapor exiting the tunnel 92 to the second stage 140 of the two stage nozzle section 120 without disturbing the directionality and stability of the jet's axial motion. The length of the straight cylindrical first stage 135 is approximately 0.5X to 10X the exit diameter of the tunnel 92, and preferably 1X to 4X the exit diameter of tunnel 92.

The second stage 140 of the two stage nozzle section 120 comprises a diverging conical shape extending from the generally cylindrical first stage 135 to the exit end 132 of the nozzle section 120. The diverging angle $\alpha$ of the second stage 140 has been found to be suitable between one to about 20 degrees with respect to the axis or centerline of the apparatus 100 (also referred to as the half angle) but is preferably in the range of 4 to 12 degrees. The exit cross sectional area of the diverging second stage 140 (at the exit end 132) is at least 0.1X the cross sectional area of the collection section 150 down stream but not larger than the cross sectional area of the collection section 150. The preferred cross sectional area at the exit of the diverging section is 0.2X to 0.75X of the cross sectional area of the collection section 150. Also in the preferred embodiment, the angle of the diverging second stage 140 is such that, if the diverging second stage 140 were projected toward the tunnel 92, it would have approximately the same dimension as the exit of the tunnel 92 at the exit of the tunnel. In other words, the diverging second stage 140, in the preferred embodiment, is arranged so that an extension of the conical shape would intersect the tunnel exit with a cross sectional area that substantially corresponds to the cross sectional area of the tunnel exit.

The nozzle section 120 permits the continuation and completion of the flashing of the solvent while allowing for gradual deceleration of the jet. Under such an arrangement, it has been found that the turbulent forces are not as pronounced and the fiber may be formed into an acceptable log. In the improved design of the present invention however, there also includes an improvement in the collection section 150.

The collection section 150, as in the prior art arrangements, is a generally cylindrical tube 151 having a plurality of gas release ports 152 in the peripheral wall thereof. The ports 152 are suitably spaced and sized to permit the solvent vapor to exit while substantially preventing the fiber from exiting therethrough. However, in the present invention, the collection section 150 includes a wire mesh screen 155 lining the interior of the cylindrical bore so as to prevent fiber from easily exiting the interior of the tube 151. As such, the solvent vapor is permitted to exit through the ports 152 at substantially the same rate as in the prior art, but the fibers are less able to pass out therethrough because of the effective reduction in the size of the ports 152. The screen used is 10 mesh to 200 mesh, preferably 35 mesh to 100 mesh. Details about screens of specific mesh are given in Chemical Engineers' Handbook by R. H. Perry and C. H. Chilton, 5th Edition, Table 21-12. The screen 155 provides enough open area for gases to escape without any unacceptable pressure drop and at the same time prevents fibers from exiting through the openings in the screen 155 along with gases. This eliminates the mechanical damage to fibers that may occur in the absence of screen due to the fibers momentarily exiting the gas release ports on the collection tube. Preferably the screen is made of a Teflon impregnated nickel to provide a tough and low friction surface for the log moving through the collection section 150.

From the collection section 150, the now formed log of fiber passes into the discharge section 180. The discharge section 180 is comprised of a tubular section 181 having a generally imperforate elastomeric bladder 185 arranged to line the interior of the tubular section 181. The terminal edges of the tubular shaped bladder 185 are suitably sealed to the tubular section 181 so that the annular space 188 between the bladder 185 and the tubular section 181 may receive and hold air or other fluid through nipple 189 to change the dimension of the bladder 185 within the tubular section 181. As the annular space 188 is provided with fluid, the bladder 185 constricts the passage or essentially changes the interior dimension of the discharge section 180. To facilitate rapid evacuation of fluid, a network or matrix of grooves 191 are cut into the inner surface of the tubular section 181 so that fluid may move toward the nipple 189 even while the bladder 185 is pressed fully against the inner surface of the tubular section 181.

Log formation is initiated by collapsing the bladder by an impulse of high pressure air through nipple 189. Once the "log" formation is initiated, the bladder is allowed to quickly return to its initial dimension by releasing the air pressure. The resistance to "log" motion through the bladder is thereafter controlled by inflating the bladder to desired level during the process thus controlling the rate at which the log exits the collection section 150.

The gas pressure in the collection section 150 depends in some part on the size and number of ports 152 through which the solvent vapor may exit therefrom. The number of the ports 152 which are open depends on where the end of the log is in the collection section 150. If the beginning end (the end of the log into which the fibers are being fed) is close to the nozzle exit, the pressure (or back pressure) will be much higher than if the end of the log is closer to the discharge section 180. Accordingly, by controlling the rate at which the logs are permitted to exit from the collection section 150 essentially provides control of the back pressure in the collection section 150.

The back pressure has a significant effect on fiber quality and it is preferred to control the back pressure to desired level during the process to maintain the quality of the fiber. If the back pressure is too low, the "logs" produced are too soft to handle. If the back pressure is too high, flash spun fibers are not well fibrillated and also the process is more prone to fail due to fibers being blown out through the gas release ports on the collection tube.

Accordingly, the present invention provides a significant improvement over prior art arrangements in that the industry will now be enabled to produce backwindable fiber having higher tenacity and strength. Backwindable fiber logs can now be made using a tunnel of the type that has long been known to provide greater tensile strength.

Now that the apparatus 100 of the invention has been set forth, the process in which the apparatus is used will now be described. As noted above, the apparatus is to be substituted for prior fiber receiving and log forming arrangements. The apparatus for spinning the fiber strand is essentially the same as described in prior art patents. However, in contrast to the prior log making arrangements, the spinneret includes a tunnel at the exit thereof to enhance the acceleration of the flashing solvent vapors and provide enhanced tensile strength for the spun fibers. The fiber strand passes from the tunnel and into the nozzle section 120 where the lateral expansion continues in a diverging, continuously expanding arrangement gradually slowing the expanding jet of solvent vapor.

As the fiber strand passes out of the nozzle section 120 and into the collection section 150, the solvent vapor has slowed considerably so that the fiber can be collected. The collection section 150 includes the ports 152 which permit the solvent vapor to escape from the collection section. The fiber strand is collected into the log with sufficient force to form a stable and suitable log. Portions of the fiber which move to the periphery of the collection conduit are retained therein by the mesh screen while the mesh screen does not substantially create excessive back pressure in the nozzle and tunnel. The log then slowly moves out of the conduit and into the discharge section. The bladder is arranged to control the discharge of the log based on the physical qualities of the log and the fiber therein, and on the rate at which the fiber is being delivered into the apparatus.

While the invention has been described as a combination of at least three improvements to the prior apparatuses, it should be clearly understood that not all the described improvements are necessary together. While it is preferable that all are used in conjunction to form the preferred apparatus as described and illustrated in FIG. 2, each may be used independent of the others to improve the operation of prior apparatuses.

The above-described invention will now be illustrated by the following non-limiting examples.

EXAMPLE 1

A solution of 12%, by weight, of high density polyethylene (HDPE—melt index 0.75; stress exponent 1.45; rheology number 46; specific density 0.957; number average molecular weight 28000 and weight average molecular weight 135000) was prepared in Freon-11 solvent at 180° C. and 1500 psi. Solution pressure was then dropped to 930 psi to create two phase solution prior to flash spinning. Spinneret size was 0.047 in. and there was no tunnel at the spinneret exit. The spinneret was connected to the collection tube via a 120 degree flared opening (60 degree half angle) at the spinneret exit as shown in FIG. 1. The collection tube ID was 1.5 in. and was 10 in. long. Gas release ports were 0.125 in. diameter and were 18 degree apart around the circumference. Gas release port rows were 0.25 in. apart and were staggered along the length of the fiber collection tube as shown in FIG. 1. There was no screen inside the collection tube. Several rubber gaskets were used at the collection tube exit to achieve desired resistance to the log motion for log making process. A mechanical gate was used at the exit to initiate the logmaking process. The overall equipment assembly is generally as shown in FIG. 1.

During the test, polymer flow rate was 91 pph. Fibers momentarily projected out through the first 2 to 3 rows of gas release ports in the collection tube by about 0.25–0.75 in. This yielded heavy axial lines on the surface of the logs and damaged the continuity of the fibers. Also, fibers had heavy and poorly fibrillated regions. The web tenacity was 3.4 gpd.

EXAMPLE 2

The solution supplied and equipment set-up were the same as in Example 1 except an appropriately sized tunnel was used at the spinneret exit. The tunnel exit diameter was 0.423 and was 0.27 in. long. Tunnel diverging angle with respect to the center axis was 10 degrees. The tunnel opened into the collection tube.

During the test, significant difficulties were encountered while establishing initial "log" formation at the start-up. Even when "log" formation was established, the process kept failing almost instantaneously either due to blow out of the formed "log" from the collection tube or blow out of fibers from the gas release ports.

EXAMPLE 3

Solution supply and equipment set-up were same as Example 2 except collection tube diameter was 2.0 in. The process formed "logs". However, fibers in the "logs" were totally entangled and back winding of flash spun fibers from these "logs" was not feasible.

EXAMPLE 4

The solution supply and equipment set-up were same as in Example 2 except that a two stage nozzle, substantially as illustrated in FIG. 2, was added at the tunnel exit. Entrance diameter of the two stage nozzle was 0.51 in. creating a step increase in cross section area at the tunnel exit. The length of the straight portion of the nozzle was 0.93 in. The diverging section had a 4 degree diverging angle with respect to center axis. The exit diameter of diverging section was 1.00 in.

During the test, both "log" formation initiation at the start as well continuation of the "log" making process was without any difficulties. However, the process appeared to be more sensitive and unstable due to flash spun fibers momentarily projecting out from first few rows of gas release ports on the collection tube.

Due to the latter problem, the continuity of the plexifilamentary structure of flash spun fibers was damaged similar to Example 1. However, unlike Example 1, the web produced during this test was very well fibrillated and strong (5.1 gpd). Also, there were no defects, such as heavy and poorly fibrillated regions.

EXAMPLE 5

The solution supply and equipment set-up were same as in Example 4 except 100 mesh standard screen was used inside the collection tube as shown in FIG. 2. With the use of the screen, problems associated with the fibers projecting out of the gas release ports as in Example 4 were eliminated. However, the fiber was very poorly fibrillated. In order to improve fibers fibrillation, 30 mesh size screen was tried and was found have to have excessively large openings to retain the fibers. A screen size of 50 mesh was found to be optimum for this test. It retained fibers inside the collection tube at the same time screen opening size was large enough for the gases to escape without excessive pressure drop. The flash spun fibers were strong and the plexifilamentary structure was very well fibrillated similar to Example 4. At the same time, the backwindability of fibers from the logs produced during this test was extremely good and continuity of plexifilamentary structure of flash spun fibers was very good as well.

EXAMPLE 6

The solution supply and equipment set-up were the same as in Example 5 except an inflatable bladder was used instead of the rubber gaskets and the mechanical gate at the exit of fiber collection tube. The rubber bladder was made up of neoprene rubber. The thickness of bladder wall was 0.050 in. having durometer of about 70. The inside of the metal cylinder supporting the inflatable bladder was provided with a network of grooves 191 to facilitate the escape of the air through the air supply entrance hole. Air supply pressure was 45 psig.

A very short burst of 45 psig air was supplied to the bladder at the start to initiate log formation. The air inflated the bladder to constrict down on and close the exit of the fiber collection tube momentarily. Within a split second the bladder retracted back to its initial position by releasing the air pressure. Bladder diameter was matched with the diameter of "log" exiting the fiber collection tube in a way that no air pressure was applied to the bladder once the "log" formation had started. However, bladder was inflated slightly during the test whenever logs appeared to be too soft to handle.

Fibers quality and "logs" quality were extremely good as described in Example 5. In this example, both a straight tube and a short section of bicycle tube were tried as the bladder and both were found to function equally very well.

EXAMPLE 7

The solution supply and equipment set-up were the same as in Example 6 except the preferred two stage nozzle was replaced by single stage diverging nozzle at the tunnel exit. This nozzle did not have straight cylindrical section at the entrance and had only a conical diverging section. However, there was a step increase in cross section area at the tunnel exit due to nozzle entrance diameter 0.51 in. as compared to tunnel exit diameter 0.423 in. The diverging angle of the nozzle was 4 degrees with respect to center axis and exit diameter was 1.0 in. as in Example 6.

During the test, the process was not as stable as Example 6 (fluctuations in "log" motion velocity). Also, fibers in the "log" were not packed in a very backwindable manner as in Example 6.

EXAMPLE 8

The solution supply and equipment set-up were the same as in Example 7 except that the nozzle at the tunnel exit had neither a straight section (like Example 7) nor a step increase in cross sectional area at the tunnel exit (unlike Example 7). The entrance diameter of the nozzle was 0.450" as compared to tunnel exit diameter 0.423". The diverging angle was 4 degrees (half angle) and exit diameter was 1.0 in. similar to Example 7.

Plexifilamentary structure of flash spun fibers in logs formed during this test was very poorly fibrillated. This test was repeated with an increased diverging angle to the same angle as the tunnel diverging angle, i.e. 10 degrees. Fibrillation of plexifilamentary structure did improve, however, the process was still very unsatisfactory. Also, "log" formation process became unstable.

EXAMPLE 9

The solution supply and equipment set-up were the same as in Example 6 except that the collection tube had gas release ports 9 degrees apart in each row instead of 18 degrees apart. The screen size was 50 mesh.

During the test, fibers blew out through the screen and the gas release ports. As such, the logs produced during this test were unsatisfactory.

Although particular embodiments of the present invention have been described in the foregoing description, it will be understood by those skilled in the art that the invention is capable of numerous modifications, substitutions and rearrangements without departing from the spirit or essential attributes of the invention. Reference should be made to the appended claims, rather than to the foregoing specification, as indicating the scope of the invention.

I claim:

1. A method for producing highly oriented, high strength continuous, backwindable fibers in the form of a rod-shaped batt, comprising the steps of:

flash-spinning continuous fibers through a spinneret and into a tunnel so that the fibers and gases are directed into a nozzle section;

gradually slowing down the gases and the fiber in the nozzle section wherein the cross sectional area of the nozzle section diverges at a half angle of not greater than about 20 degrees; and collecting the fibers into a rod-shaped batt in a collection tube while discharging the flash spun gases through peripheral openings in the peripheral wall of the collection tube.

* * * * *